US006916214B2

(12) United States Patent
Conrad

(10) Patent No.: US 6,916,214 B2
(45) Date of Patent: Jul. 12, 2005

(54) CONNECTING TERMINAL

(75) Inventor: Gerd Conrad, Mastbruchstrasse 213A, D-33104 Paderborn (DE)

(73) Assignees: Gerd Conrad, Paderborn (DE); Heinrich Hoelscher, Paderborn (DE)

( * ) Notice: Subject to any disclaimer, the term of this patent is extended or adjusted under 35 U.S.C. 154(b) by 0 days.

(21) Appl. No.: 10/650,053

(22) Filed: Aug. 26, 2003

(65) Prior Publication Data

US 2004/0152367 A1 Aug. 5, 2004

(30) Foreign Application Priority Data

| | | |
|---|---|---|
| Aug. 28, 2002 | (DE) | 102 39 367 |
| Nov. 19, 2002 | (DE) | 102 53 861 |
| Apr. 4, 2003 | (DE) | 103 15 668 |

(51) Int. Cl.[7] ..... H01R 9/26
(52) U.S. Cl. ..... 439/716

(58) Field of Search ..... 439/715, 716, 439/717, 94

(56) References Cited

U.S. PATENT DOCUMENTS

| | | | | | |
|---|---|---|---|---|---|
| 4,113,982 | A | * | 9/1978 | Glaesel | 174/158 R |
| 4,269,471 | A | * | 5/1981 | Woertz | 439/94 |
| 5,022,873 | A | * | 6/1991 | Kollmann | 439/716 |
| 6,183,311 | B1 | * | 2/2001 | Suess et al. | 439/716 |

* cited by examiner

*Primary Examiner*—Ross Gushi
(74) *Attorney, Agent, or Firm*—Laurence A. Greenberg; Werner H. Stemer; Ralph E. Locher

(57) ABSTRACT

A connecting terminal has a connecting structure with a connector that allows making contact with at least one conductor. The connecting structure further has a conductor track connection for connecting the connecting terminal to a profiled protective conductor bar. The conductor track connection is integrally connected to the connecting structure in one piece.

20 Claims, 4 Drawing Sheets

CONNECTING TERMINAL

BACKGROUND OF THE INVENTION

Field of the Invention

The invention relates to a connecting terminal having a conductor rail or connecting structure, which has devices for making contact with at least one conductor to be connected and a conductor track connection for connecting the connecting terminal to a profiled protective conductor bar.

Numerous configurations are known for such connecting terminals, for example in the form of terminal strips, which differ from one another in particular with regard to the means used for making contact with the conductors to be connected, in particular spring or screw terminal elements being conventional. In order to be able to connect the connecting terminal to a profiled protective conductor bar, the connecting structure is provided with a conductor track connection which is usually formed from a number of parts which are riveted, soldered, welded or otherwise connected to the connecting structure.

SUMMARY OF THE INVENTION

It is accordingly an object of the invention to provide a connection terminal, which overcomes the above-mentioned disadvantages of the heretofore-known devices and methods of this general type and which further develops the generic connecting terminal with a simplified physical configuration, can be produced more cost-effectively and can be attached to and detached from the protective conductor bar more easily.

With the foregoing and other objects in view there is provided, in accordance with the invention, an improved connecting terminal of the type having a connecting structure with a device for contacting at least one conductor to be connected via the connecting terminal and with a conductor track connection for connecting the connecting terminal to a profiled protective conductor bar. The improvement resides primarily in the fact that the conductor track connection is integrally formed in one piece with the connecting structure.

It is expedient for the conductor track connection to have a base segment and a resilient latching segment.

The invention preferably provides for the conductor track connection to have a locking section. The locking section can be designed to be resilient.

The invention preferably provides for the latching section and/or the locking section to be formed by resilient sections in the form of fingers.

The latching section can have a latching projection for engaging behind a profiled region, which is, for example, in the form of a flange, of the protective conductor bar.

The locking section can have a bearing projection for bearing against the protective conductor bar.

It may also be provided for the base section to have at least one contact projection for bearing against the protective conductor bar.

The invention preferably provides for the connecting structure to be produced, in particular stamped, from flat sheet metal. In particular, the connecting structure can be stamped from galvanized sheet copper. The connecting structure may be flat.

It is expedient for the conductor track connection to be designed for engaging behind a protective conductor bar which is, in cross section, in the form of a pot and has a U-shaped central region and two edge regions, in the form of flanges, emanating from this central region.

The connecting structure usually has at least one spring terminal element and/or with at least one screw terminal element. Two or more spring terminal elements and/or screw contacts are preferably provided for connecting a number of conductors.

Other features which are considered as characteristic for the invention are set forth in the appended claims.

Although the invention is illustrated and described herein as embodied in a connecting terminal, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
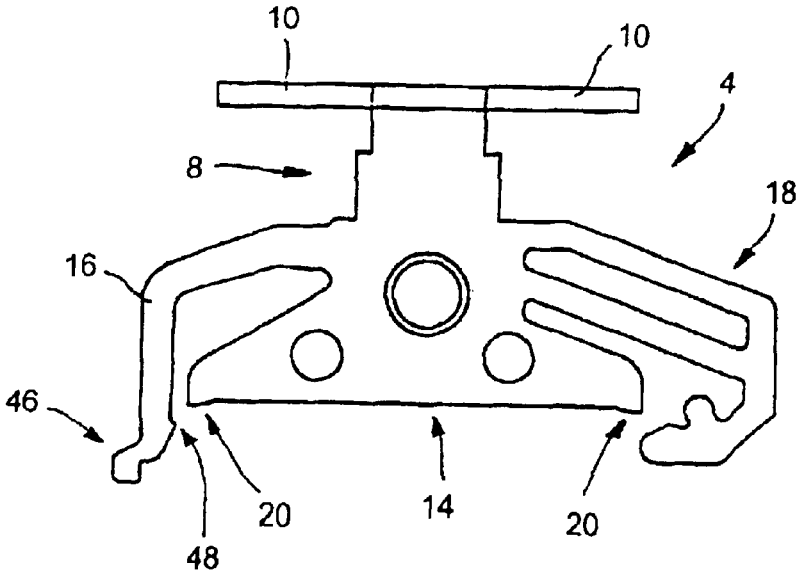
FIG. 1 is an elevational view of a connecting structure of a connecting terminal in a first embodiment.
Figure 2:
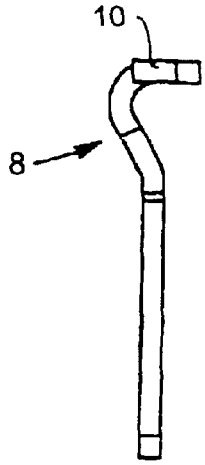
FIG. 2 is a side view of the connecting structure shown in FIG. 1.
Figure 3:
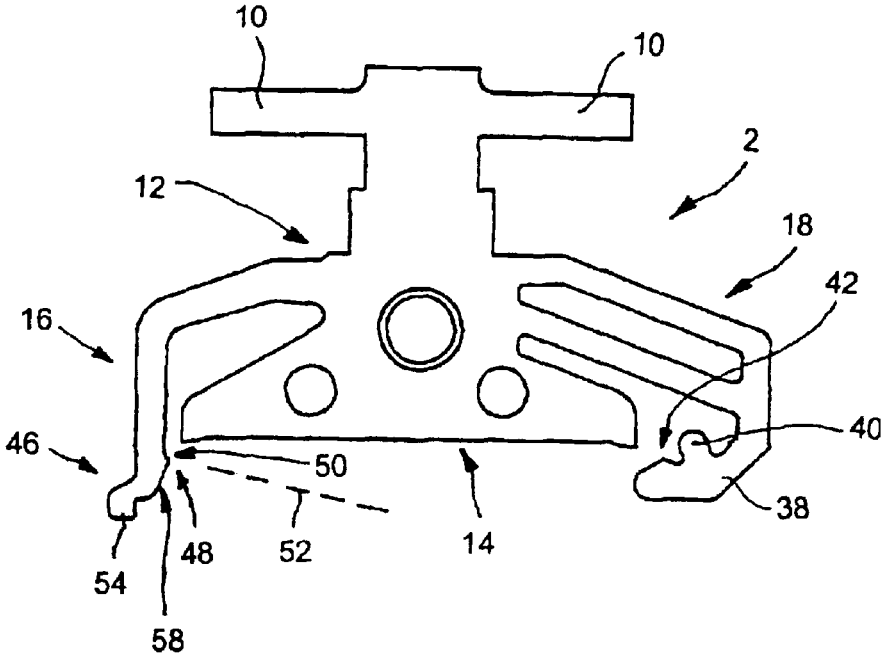
FIG. 3 is an elevational view of a flat, stamped sheet metal part for producing the connecting structure shown in FIGS. 1 and 2.

Referring now to the figures of the drawing in detail and first, particularly, to FIGS. 1–6 thereof, there is shown a first embodiment of the invention. FIG. 3 shows a plan view of a flat, stamped sheet metal part 2 which is used to produce a connecting structure 4 of a connecting terminal denoted overall by 6. As shown in FIGS. 1 and 2, an intermediate region 8 of the stamped sheet metal part 2 is bent back for this purpose approximately in the form of an S such that connecting lugs 10 originally lying in the plane of the metal sheet (plane of depiction) lie perpendicular to their original position and perpendicular to the plane otherwise defined by the otherwise flat connecting structure 4.

The stamped sheet metal part 2 and the connecting structure 4 produced therefrom have, adjacent to the intermediate region 8, a central section 12 which is adjoined on one side by a base section 14 and on the other side by two resilient sections in the form of fingers, namely a latching section 16 and a locking section 18. The base section 14, the latching section 16, and the locking section 18 together form a conductor track connection.

All of said regions of the connecting structure or the stamped sheet metal part 2 are, as mentioned, produced by being stamped from a flat sheet metal material.

Figure 4:
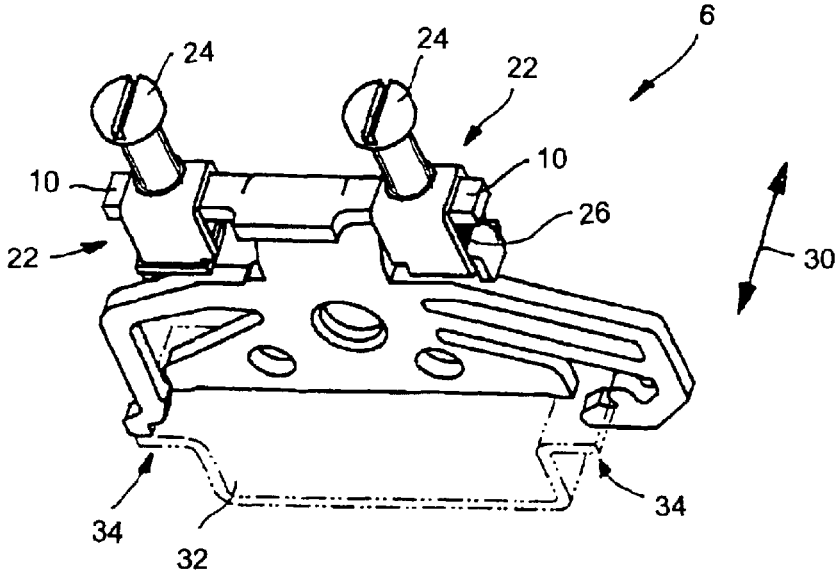
FIG. 4 is a perspective view of a connecting terminal according to the invention in a first embodiment having a connecting structure as shown in FIGS. 1 to 3, and a phantom view of a protective conductor track.
Figure 5:
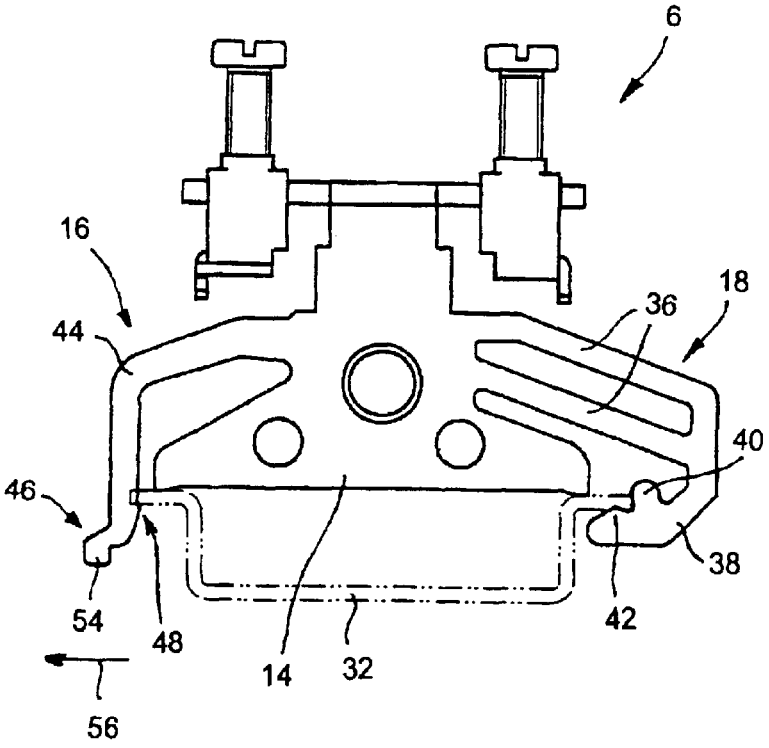
FIG. 5 is an elevational view of the connecting terminal shown in FIG. 4.
Figure 6:
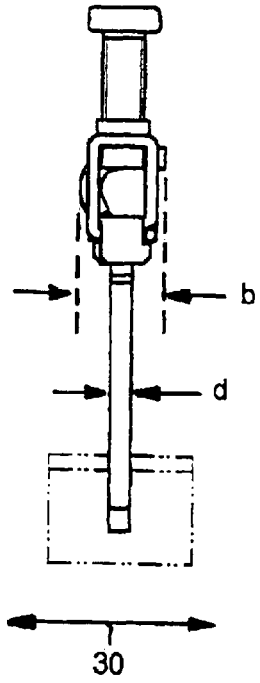
FIG. 6 is a side view of the connecting terminal shown in FIGS. 4 and 5.

FIGS. 4 to 6 illustrate the connecting terminal 6, according to the invention, of the first embodiment, in this case the means for making contact with the conductor to be connected being formed by screw terminal elements 22 which are pushed onto the connecting lugs 10. Terminal screws 24 serve the purpose of holding, by clamping, a non-illustrated conductor, which has been pushed in, between a bottom wall 26 of a screw terminal element 22 and a connecting lug 10.

As shown, in particular, in FIG. 6, a width b of the connecting terminal 6, i.e. its dimension in a direction 30 of the arrangement—i.e., a longitudinal direction of the conductor track assembly—is relatively small owing to the chosen design and is, in this example, only approximately four times a sheet metal thickness d of the sheet metal material used for producing the connecting structure 4.

FIGS. 4 and 5 show how the connecting terminal 6 is held on a profiled protective conductor bar 32. The protective conductor bar 32 has a cross-sectional profile, which is in the form of a pot or essentially U-shaped and is provided with bent-back edge sections 34 in the form of flanges, and its longitudinal direction corresponds to, or determines, the above-mentioned direction 30 of the arrangement.

The base section 14 of the connecting structure 4 bears with each of its two contact projections 20 (FIG. 1) against one of the edge sections 34. The locking section 18 has two parallel webs 36 which at one end are connected to the central section 12 and at the other end have a locking end 38 which engages behind one of the edge sections 34 and on which a bearing projection 40 is formed which bears laterally against the edge section 34 and thereby determines the position of the connecting terminal 6 transversely with respect to the direction 30 of the arrangement. The locking end 38 being connected to the central section 12 by means of two relatively narrow webs 36 results in a certain pliability or resilience between the locking end 38 and the central section 12, which can be set or predetermined by the length and width of the webs 36. A contact projection 42 is formed on the locking end 38 in order to increase the compressive load per unit area on the protective conductor bar 32 and to produce a good contact.

The latching section 16 has, in contrast to the locking section 18, only one web 44, with the result that a free end section 46 of the latching section 16 is more resilient than the locking end 38 of the locking section 18. As shown, in particular, in FIG. 3, the latching section 16 has a latching projection 48 on its free end section 46, this latching projection engaging behind the other edge section 34 of the protective conductor bar 32. In order for as much contact force as possible against the contact projection of the base section 14 to be achieved in this region too, the latching projection 48 has an inclined latching face 50 which bears against the latching section 34 in the latched-on state and, in combination with the spring force which is achieved owing to the formation of the latching section 16, increases the pressure of the latching section against the contact projection. The inclination of the sloping latching face 50 is indicated in FIG. 3 by a dashed line 52.

A grip section 54 on the outermost end of the free end section 46 of the latching section 16 makes it possible for a detachment tool, for example a screwdriver, to be used to move the latching section 16 in the detachment direction 56 in a resilient manner, with the result that the latching projection 48 is detached from the edge section 34, and the connecting terminal 6 can be removed from the protective conductor bar 32. A push-on slope 58 makes it possible to push or latch the connecting terminal 6 onto the protective conductor bar 32 in a simple manner, without the need for tools. For this purpose, the connecting terminal 6 is first pushed onto one of the edge sections 34 on the side of the locking section 18, the locking end 38 of the locking section 18 engaging under the edge section and the bearing projection 40 of said locking section being brought to bear against it. Then, the connecting terminal 6 is pivoted about the bearing region (bearing projection 40 or contact projection 42) until the push-on slope 58 comes into contact with the opposite edge section 34, and, further, the latching section 16 being opened in a resilient manner until the latching projection 48 on the latching section 16 springs back and the latching face 50 of said latching section engages behind the edge section 34. In this state, the connecting terminal 6 is held securely on the protective conductor bar 32 until it is released by the latching section 16 being bent back.

The locking section 18, and in particular its contact projection 42, is designed such that its distance, perpendicular to a line connecting the contact projections 20 of the base section 14, is smaller in the unloaded state than the thickness of the edge section 34, with the result that, in the latched-on state, the locking section 18 is prestressed in a resilient manner and a desired contact force is generated. The same applies to the inclined latching face 50 of the latching section 16, with the result that here too, in the latched-on state, the latching section 16 is stressed in a resilient manner, and a contact force is generated owing to the inclination of the latching face 50.

Figure 7:
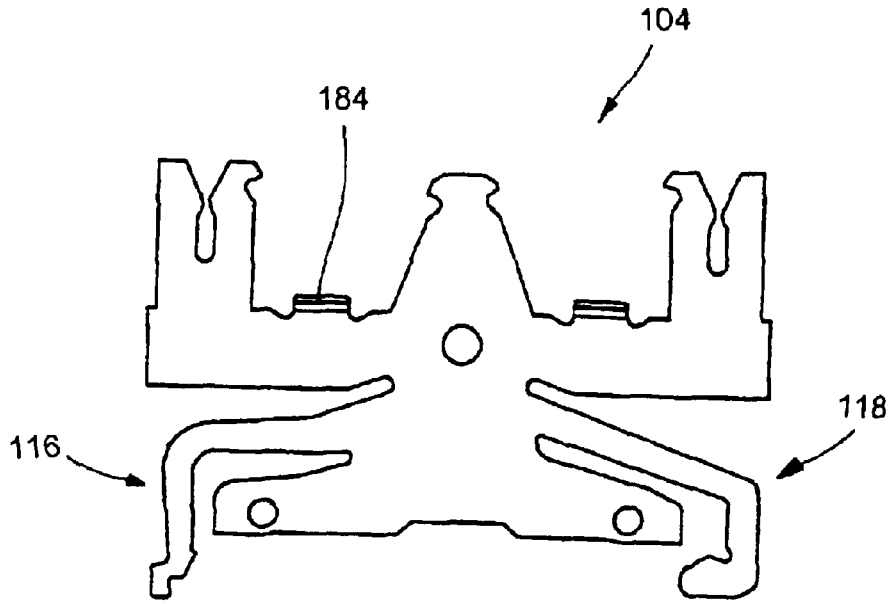
FIG. 7 is an elevational view of a connecting terminal for a connecting structure, according to a second embodiment.
Figure 8:
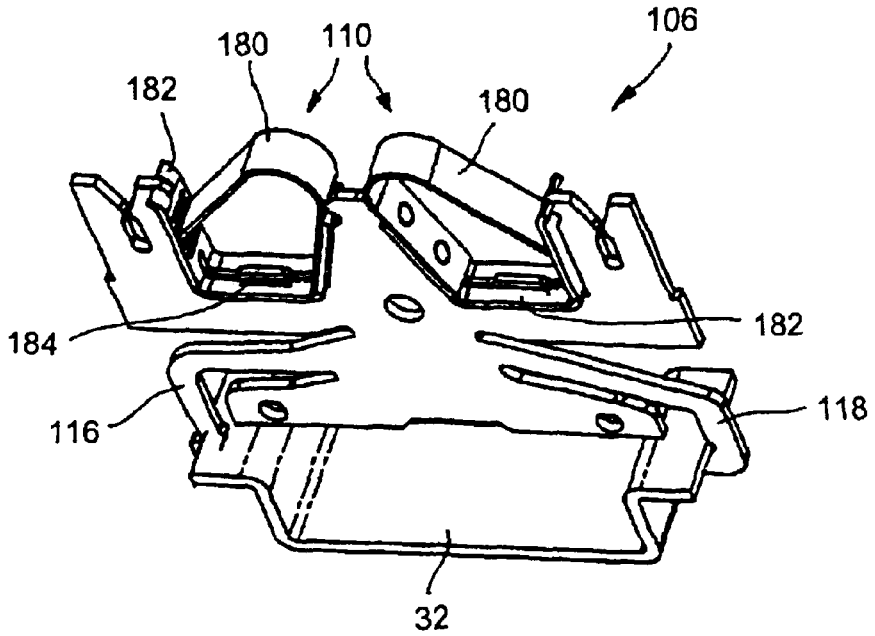
FIG. 8 is a perspective view of the second embodiment of the connecting terminal of FIG. 7, illustrated with a connecting structure.

FIGS. 7 and 8 show an alternative embodiment of a connecting terminal according to the invention which is denoted overall by 106 and is provided with a flat connecting structure 104 and two spring terminal elements 110. The spring terminal elements 110 have in each case one spring limb 180 and a contact limb 182 and are conductively connected to the connecting structure 104. The contact limbs 182 are conductively connected to the connecting structure 104 by means of rivet projections 184 which are formed on said connecting structure.

As in the first embodiment, the connecting terminal 106 has a latching section 116 and a locking section 118 which are similar in form to those in the first embodiment and, in a corresponding manner, engage behind the protective conductor bar 32, illustrated in FIG. 8, in a resilient manner.

Figure 9:
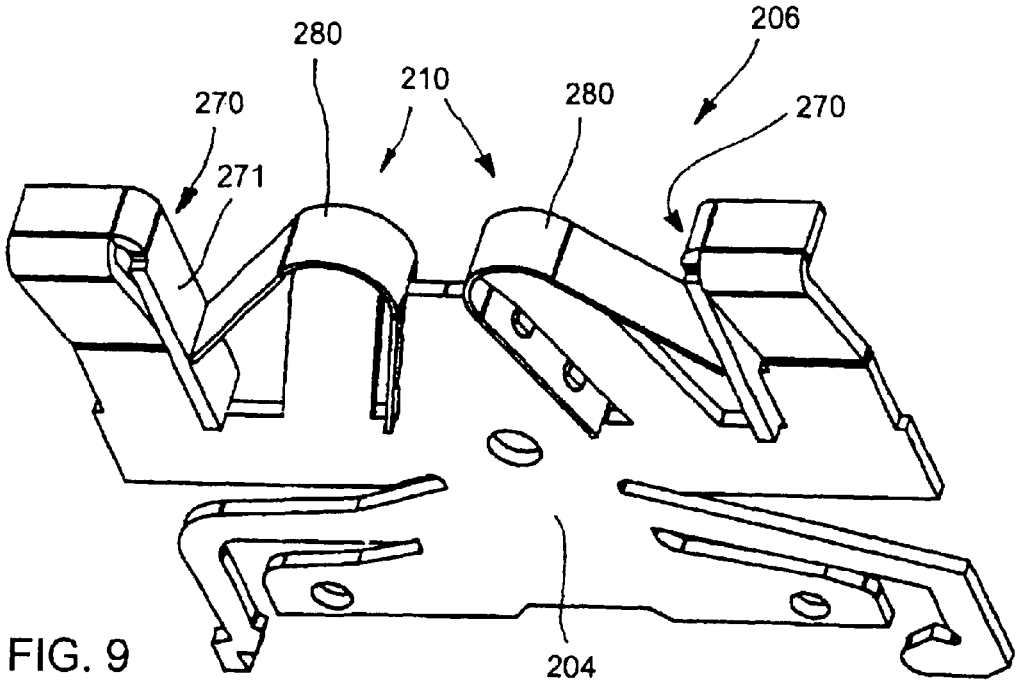
FIG. 9 is a perspective view of a third embodiment of the connecting terminal according to the invention.
Figure 10:
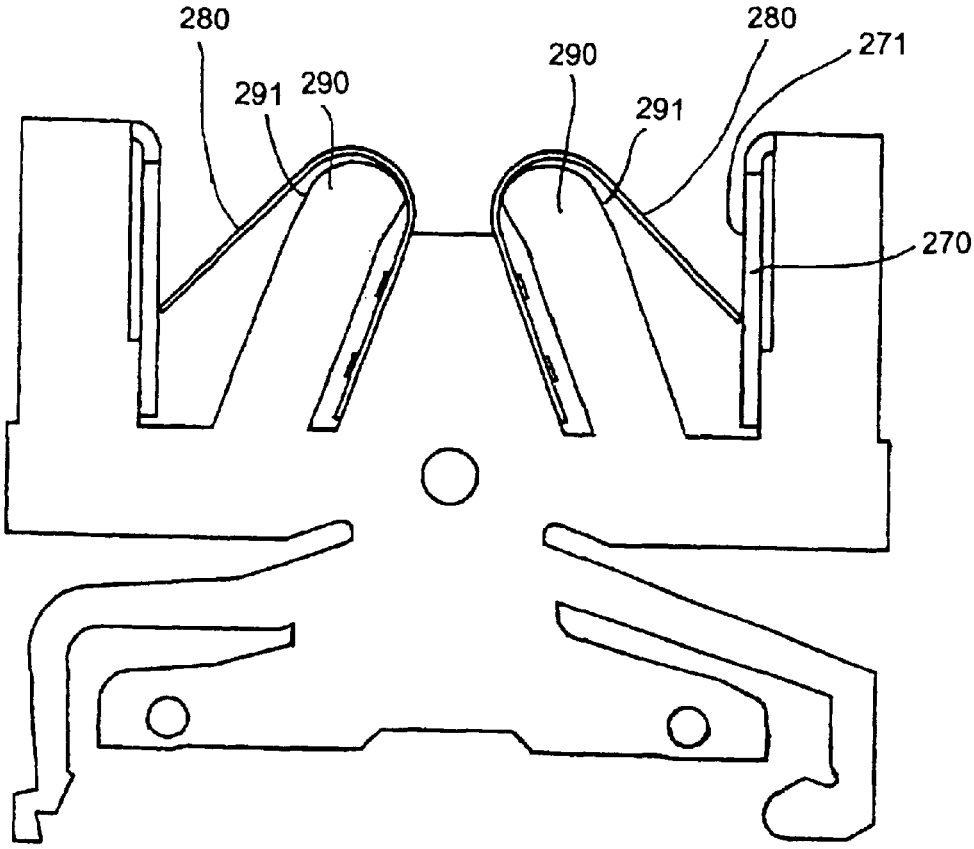
FIG. 10 is an elevational view of the connecting terminal shown in FIG. 9.

FIGS. 9 and 10 illustrate a further embodiment of a connecting terminal 206 according to the invention, in which spring terminal elements 210 are likewise provided. In contrast to the connecting structure 104 of the second embodiment shown in FIGS. 7 and 8, the connecting structure 204 of the third embodiment is not entirely flat but has two regions 270 which are bent back perpendicular to a plane of extent of the connecting structure (plane of depiction in FIG. 10) and which form contact faces 271 which serve the purpose of making contact with a conductor which is pushed in between these contact faces and spring limbs 280 of the spring terminal element 210. The contact limb 182 of the second embodiment is thus replaced here by the bent-back regions 270.

A stop 290 having a curved bearing face 291 is designed to be integral with the connecting structure 204, which increases the spring constant of the spring terminal element 210 since the spring limb 280 bears to an increasing extent on the bearing face 291 as it bends increasingly toward the stop 290, which results in the effective length of the limb being shortened and thus in the resilience being increased.

I claim:

1. In a connecting terminal having a connecting structure with a device for contacting at least one conductor to be connected via the connecting terminal and with a conductor track connection for connecting the connecting terminal to a profiled protective conductor bar, the conductor bar having lateral flanges disposed in a common plane, the improvement which comprises:

the conductor track connection being integrally formed of metal in one piece with the connecting structure, and the conductor track connection including:

a base section, formed with contact projections configured to abut against the lateral flanges of the conductor bar, and a resilient latching section with a latching projection configured to cooperate with a section of the conductor bar in arresting the connecting terminal on the conductor bar;

a locking section formed with a locking contact projection and configured to cooperate with said base section in locking the connecting terminal to further section of the conductor bar;

whereby the connecting terminal connects to the conductor bar by locking one of the lateral flanges between said locking contact projection and one of said contact projections of said base section; and by latching another of the lateral flanges between said latching projection and another of said contact projections of said base section.

2. The connecting terminal according to claim 1, wherein said locking section is a resilient structure.

3. The connecting terminal according to claim 1, wherein at least one of said latching section and said locking section is formed by resilient fingers.

4. The connecting terminal according to claim 1, wherein said latching section has a latching projection for engaging behind a profiled region of the protective conductor bar.

5. The connecting terminal according to claim 1, wherein said locking section has a bearing projection for bearing against the protective conductor bar.

6. The connecting terminal according to claim 1, wherein said base section is formed with at least one contact projection for bearing against the protective conductor bar.

7. The connecting terminal according to claim 1, wherein said connecting structure is formed from sheet metal.

8. The connecting terminal according to claim 1, wherein said conductor track connection is a stamped flat sheet metal part.

9. The connecting terminal according to claim 1, wherein said conductor track connection is substantially flat.

10. The connecting terminal according to claim 1, wherein said conductor track connection is configured to engage behind a protective conductor bar having, in cross section, a pot shape with a U-shaped central region and two edge region flanges projecting from said central region.

11. The connecting terminal according to claim 1, which further comprises at least one spring terminal element disposed on said connecting structure.

12. The connecting terminal according to claim 1, wherein said device for contacting the conductor includes at least one screw terminal element disposed on said connecting structure.

13. The connecting terminal according to claim 1, wherein said connecting terminal is a terminal strip.

14. An electric connecting terminal, comprising:

a connecting structure; and a conductor track connection for connecting the connecting terminal to a profiled protective conductor bar, the conductor bar having first and second edge flanges extending in a common plane;

said conductor track connection having:

a base section comprising first and second base contact projections for respectively abutting against the first and second edge flanges;

a resilient locking section with a looking contact projection; and a resilient latching section with a latching projection;

said locking section and said latching section being configured to encompass opposing ends of the first and second edge flanges; and said base section, said locking section, and said latching section being integrally formed from sheet metal;

wherein the connecting terminal is connectable to the profiled protective conductor bar by:

first, locking the first edge flange between said locking contact projection and said first contact projection of said base section; and second, latching the second edge flange between said latching projection and said second contact projection of aid base section.

15. The connecting terminal according to claim 14, wherein at least one of said latching section and said locking section is formed by resilient fingers.

16. The connecting terminal according to claim 14, wherein said locking section has a bearing projection for bearing against the protective conductor bar.

17. The connecting terminal according to claim 14, wherein said connecting structure is formed from sheet metal.

18. The connecting terminal according to claim 14, wherein said conductor track connection is a stamped flat sheet metal part.

19. The connecting terminal according to claim 14, which further comprises at least one spring terminal element disposed on said connecting structure.

20. The connecting terminal according to claim 14, wherein said device for contacting the conductor includes at least one screw terminal element disposed on said connecting structure.

* * * * *